US005127142A

United States Patent [19]

Howard

[11] Patent Number: 5,127,142

[45] Date of Patent: Jul. 7, 1992

[54] RELATING TO CALENDER AND EMBOSSING BOWLS

[75] Inventor: Terence G. Howard, Wigan, England

[73] Assignee: David Bently Limited, Manchester, England

[21] Appl. No.: 665,699

[22] Filed: Mar. 7, 1991

[30] Foreign Application Priority Data

Mar. 7, 1990 [GB] United Kingdom ..... 9005072

[51] Int. Cl.[5] ..... B21B 31/08

[52] U.S. Cl. ..... 29/121.6; 29/123; 29/130

[58] Field of Search ..... 29/123, 125, 121.1, 29/121.6, 130, 131

[56] References Cited

U.S. PATENT DOCUMENTS

| | | | |
|---|---|---|---|
| 292,958 | 2/1884 | Smith | 29/121.6 X |
| 1,517,036 | 11/1924 | Wagner | 29/121.6 |
| 1,734,297 | 11/1929 | Kitchen | 29/121.6 X |
| 1,753,201 | 3/1928 | Edlich | 29/121.6 X |
| 2,005,885 | 6/1935 | Brindley . | |
| 2,136,747 | 11/1938 | Levoy | 29/121.6 X |
| 2,280,125 | 4/1942 | Kauffield . | |
| 3,054,163 | 9/1962 | Lakin | 29/123 |
| 3,365,774 | 1/1968 | Kusters . | |
| 3,954,556 | 5/1976 | Jackson et al. | 29/123 X |
| 4,669,163 | 6/1987 | Lux et al. | 29/130 X |
| 4,976,995 | 12/1990 | Gardiner | 29/130 X |

FOREIGN PATENT DOCUMENTS

| | | | |
|---|---|---|---|
| 2032057 | 4/1980 | United Kingdom | 29/121.6 |

*Primary Examiner*—Timothy V. Eley
*Assistant Examiner*—C. Richard Martin
*Attorney, Agent, or Firm*—Brooks & Kushman

[57] ABSTRACT

A calender bowl comprises a central elongate shaft having a flange at each end thereof. This arrangement defines a region which is filled with a filler material. The region to be filled with the filler material is the annular area around the shaft and it is filled by transversely threading numerous disc-shaped sheets of fibre and possibly conducting discs, thereon. Copper rods are disposed within the filler, along all or part of the length of the calender bowl, and lie in thermal contact with the flanges to help dissipate heat.

30 Claims, 1 Drawing Sheet

RELATING TO CALENDER AND EMBOSSING BOWLS

TECHNICAL FIELD

The present invention relates to improvements in calender and embossing bowls.

BACKGROUND ART

Calender and embossing bowls are rollers against which material, usually paper, is passed under pressure to impart the desired finish or to ensure uniform thickness. They comprise an elongate steel centre shaft with a flange indented slightly inwards from each end, which flanges define a concentric bowl about the centre shaft. The bowl is filled with a compressed fibre which is usually natural, and mostly cellulosic, but can be synthetic.

Calender bowls are used for "finishing" the surfaces of materials such as magnetic tape, fabrics, or paper, with for example, a high gloss.

Embossing bowls run against engraved steel rollers, defining a rolling nip, each bowl are becoming the female part of an embossing bowl-steel roller pair. Materials such as paper napkins, for instance, are then passed through the nip of the pair.

The bowl filling material used depends on the type of material that is to be "finished", and also on the desired properties t be imparted. Most modern coating mills use woollen paper or cotton paper filled bowls. Thousands of sheets of cotton or woollen paper are axially threaded onto the centre shaft and compressed together under hydraulic pressure to form a compact medium of material. The speeds at which bowls can rotate and the pressures to which the bowl filling material and the material being finished can be subjected, are limiting factors in these processes.

A problem common to these processes, however, is that they require or generate heat. This effect can be detrimental to the contents of the bowl, and with the rise in temperature, the cellulose, or other filling material may overheat and start to burn. The by-products of the combustion of cellulose are carbon and water, the accumulation of which can give rise to pockets of liquid of increased volume within the filling material, principally near the peripheries of the bowls, which in turn give rise to bursts within as well as on the surface of the filling material on the bowl. Thus, bowls which are run under much hotter conditions are traditionally made of asbestos. Although it works well, asbestos is now regarded as an unacceptable material to use on account of the potentially harmful effects to health caused by long-term exposure.

Current efforts at dissipating heat from the bowl material include inserting copper foil discs in between the sheets of woollen or cotton paper which make up the filling. The discs are included to draw heat away from the filling to the centre shaft. In an attempt to further improve the dissipation of heat the centre shaft has been hollowed out and a fluid coolant, usually water, passed through the hollowed shaft. As heat is generated within the bowl, it is conducted along the copper discs to the shaft whereupon the heat is drawn away by the fluid coolant. Few machines can however accommodate such a water cooling process, making the latter approach of somewhat limited application.

It is an object of the present invention to produce a means of dissipating heat from the bowls more efficiently so that heat damage to the bowls can be reduced and running speeds increased.

SUMMARY OF THE INVENTION

In accordance with a first aspect of the present invention, there is provided a calender bowl having a central elongate shaft, and a flange at each end thereof, which arrangement defines a region to be filled with a filler material characterised in that one or a plurality of first heat conducting elements are disposed longitudinally in said filler material.

Preferably the heat conducting elements are in thermal contact with the flanges.

The region to be filled with a filler material is advantageously an annular region around the shaft, and the filler material therein comprises numerous annular disc-shaped sheets which are transversely threaded onto the shaft, the sheets being hydraulically compressed.

The sheets are preferably fibrous and cellulosic in nature.

Advantageously, second heat conducting elements are disposed transversely in said material.

The second heat conducting elements are preferably annular foil sheets or discs of copper which may be of smaller diameter than the paper discs, and which are also disposed on the shaft, intermittently packed between the paper discs.

Advantageously, the discs are a fraction of a millimeter in thickness and are axially disposed on the shaft at regular intervals, for example, every 6 mm along the bowl, thus forming a bowl filling of copper and paper.

The copper discs are preferably in thermal contact with the steel shaft, which can itself be copper coated to increase conductivity.

Preferably, the first heat conducting elements are metal rods, preferably of copper, and preferably of 1 cm to 3 cm in diameter, which are inserted into the bowl filling at one or both ends of the bowl so that the rods are disposed along part or all of the length of the calender bowl.

Advantageously, a plurality of holes are longitudinally bored into the flanges and the bowl filling so as to receive the copper rods, each rod thus piercing each of a linear array of copper discs with which it is in thermal contact where such discs are present.

At least one end of each rod is preferably received by a flange so that the rods are in thermal contact with the flanges.

The rods are preferably arranged in a concentric pattern about the central shaft.

BRIEF DESCRIPTION OF THE DRAWINGS

By way of example only, specific embodiment of the present invention will now be described with reference to the accompanying drawings, in which.

BEST MODE FOR CARRYING OUT THE INVENTION

Figure 1:
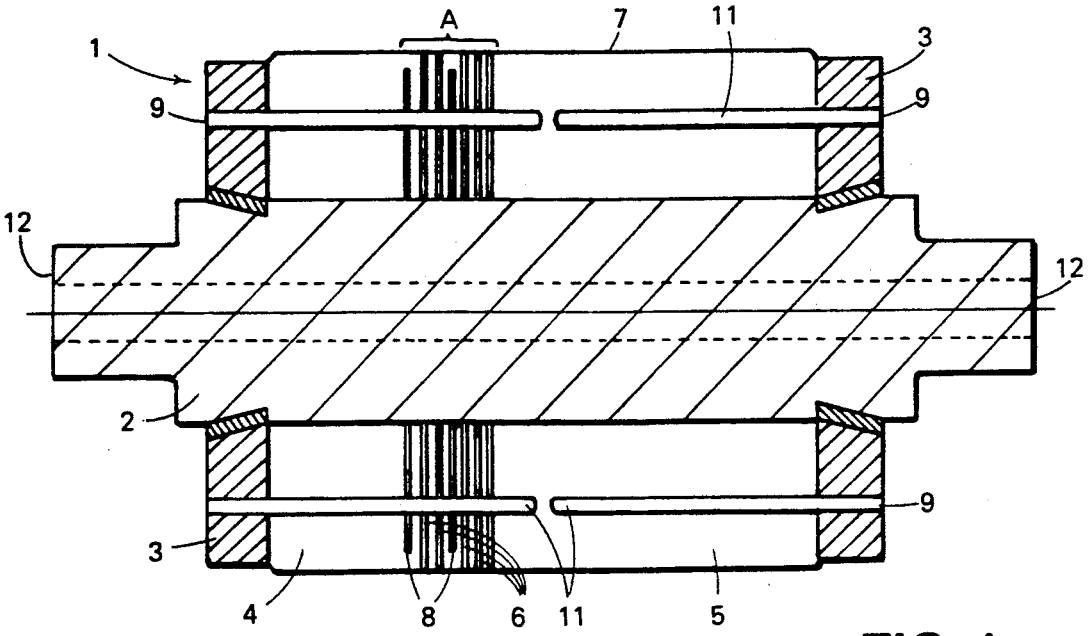
FIG. 1 is a longitudinal cross-section of a calender bowl according to the present invention; section A shows a greatly expanded section of sheets comprising the filling material.
Figure 2:
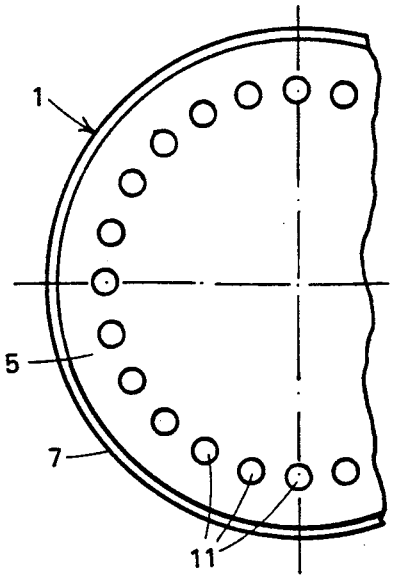
FIG. 2 is a partial transverse cross-section of the bowl in FIG. 1.

A calender bowl 1 has an elongate hollowed steel central shaft 2 having steel annular flanges 3 indented part-way inwards from either end of the shaft 2. This arrangement defines an annular region or bowl 4 around the shaft 2 which is filled with a closely packed fibrous medium 5 comprising numerous annular disc-shaped sheets of cotton or woollen paper which are transversely threaded onto the shaft. These sheets are hydraulically compressed to define a compact rigid interior of paper 5 and an outer rollable surface 7. Intermittently packed between the sheets of paper 6, prior to compression, are annular foil sheets or discs of copper 8 which are of smaller diameter than the paper discs 6, so that they do not interfere with the roller surface 7. These annular copper discs 8 are a fraction of a millimeter (mm) in thickness and are axially spaced on the shaft 2 at 6 mm intervals within the compressed medium 5, so that their inner circumferences are in thermal contact with the steel shaft 2. A circular array of holes 9 are made in each of the flanges 3 and these extend into the bowl material 5. Elongate copper rods 11 of 1 cm diameter are then inserted into the hole 9, so that when in position, the exterior surface of the rod is in thermal contact with those regions of the material 5 and those of the copper discs 8 which it has pierced, and also the flanges 3 receiving the distal ends of the rods 11.

The ends 12 of the shaft 2 engage means which enable the shaft 2 to rotate. When the calender bowl surface 7 is in frictional contact with a material surface that is to be "finished", heat is generated within the bowl filling 5, mainly at its extremities, but in smaller bowls, heat can be generated along the length of the bowl.

With the arrangement described, heat generated within the bowl filling 5 can be more efficiently conducted out of the bowl 1 by the heat sink set up by the series of thermal contacts between the components hereinbefore described. The heat generated tends to be drawn towards the copper discs 8 and rods 11, as copper is a better conductor than paper. The heat sink comprises the copper discs 8 which are in thermal contact with both the steel shaft 2 and the copper rods 11 and the latter in turn, with the flange 3. From the copper discs 8 heat is drawn into the hollow space within the shaft 2 and also from the copper discs 8, heat is drawn via the copper rods 11 to the flanges 3, the heat flow being by virtue of the temperature gradient between the temperatures of the interior of the bowl filling and its external environment.

Thus, because the heat generated is dissipated more efficiently in operation, the bowls can be subjected to greater running speeds, previously at which combustion and bursts in the roll would occur.

A comparative test has indicated that a conventional bowl, having a hollow centre shaft and copper disc disposed thereon when run at speeds of 250 m/min was cooled to 85° C., when water at a pressure of 1.8 bar was passed through the centre shaft. However, the apparatus described in the figures was cooled to 55° C., and a substantial reduction of the operation temperature of some 30° C. resulted when operated under the same conditions.

I claim:

1. A calendar bowl comprising:

a central elongate shaft having two ends, each end of the shaft having a flange thereon;

said calender bowl defining between the flanges and about but not within the central elongate shaft, a region which is filled with a filler material; and at least one first conducting element disposed longitudinally, but not coaxially with the central elongate shaft, within said filler material.

2. A calender bowl as claimed in claim 1, wherein said at least one first conducting element is in thermal contact with the flanges.

3. A calender bowl as claimed in claim 1, wherein said at least one first conducting element is from between 1 to 3 cm in diameter.

4. A calender bowl as claimed in claim 1, wherein said at least one first conducting element is disposed along part or all of the length of the calender bowl.

5. A calender bowl as claimed in claim 1, wherein said at least one first conducting element is arranged concentrically about the central elongate shaft.

6. A calender bowl as claimed in claim 1, wherein said at least one first conducting element is a metal rod.

7. A calender bowl as claimed in claim 6, wherein said metal rod is a copper rod.

8. A calender bowl as claimed in claim 6, wherein said metal rod is a copper coated rod.

9. A calender bowl as claimed in claim 1, wherein said filler material is a compressed fibre.

10. A calender bowl as claimed in claim 9, wherein said compressed fibre is a synthetic fibre.

11. A calender bowl as claimed in claim 9, wherein said compressed fire is cellulose.

12. A calender bowl as claimed in claim 1, wherein said filler material is a compressed fibre selected from the group comprising woollen paper and cotton paper.

13. A calender bowl as claimed in claim 1, which further comprises second conducting elements which are in the form of foil sheets, and which are arranged substantially perpendicular to, and in thermal contact with, said at least one first conducting element.

14. A calender bowl as claimed in claim 1, which further comprises second conducting elements which are in the form of copper discs, and which are arranged substantially perpendicular to, and in thermal contact with said at least one first conducting element.

15. An embossing bowl comprising:

a central elongate shaft having two ends, each end of the shaft having a flange thereon;

said embossing bowl defining between the flanges and about but not within the central elongate shaft, a region which is filled with a filler material; and at least one first conducting element disposed longitudinally, but not coaxially with the central elongate shaft, within said filler material.

16. An embossing bowl as claimed in claim 15, wherein said at least one first conducting element is in thermal contact with the flanges.

17. An embossing bowl as claimed in claim 15, wherein said at least one first conducting element is from between 1 to 3 cm in diameter.

18. An embossing bowl as claimed in claim 15, wherein said at least one first conducting element is disposed along part or all of the length of the calendar bowl.

19. An embossing bowl as claimed in claim 15, wherein said at least one first conducting element is arranged concentrically about the central elongate shaft.

20. An embossing bowl as claimed in claim 15, wherein the first conducting element is a metal rod.

21. An embossing bowl as claimed in claim 20, wherein said metal rod is a copper rod.

22. An embossing bowl as claimed in claim 20, wherein said metal rod is a copper coated rod.

23. An embossing bowl as claimed in claim 15, wherein said filler material is a compressed fibre.

24. An embossing bowl as claimed in claim 23, wherein said compressed fibre is a synthetic fibre.

25. An embossing bowl as claimed in claim 23, wherein said compressed fibre is cellulose.

26. An embossing bowl as claimed in claim 25, wherein said filler material is a compressed fibre selected from the group comprising woollen paper and cotton paper.

27. An embossing bowl as claimed in claim 15, which further comprises second conducting elements which are in the form of foil sheets, and which are arranged substantially perpendicular to, and in thermal contact with, said at least one first conducting element.

28. An embossing bowl as claimed in claim 15, which further comprises second conducting elements which are in the form of copper discs and which are arranged substantially perpendicular to, and in thermal contact with said at least one first conducting element.

29. A calender bowl comprising:

a central elongate shaft having two ends, each end of the shaft having a flange thereon;

said calender bowl defining between the flanges and about but not within the central elongate shaft, a region which is filled with a filler material; and at least one first elongate conducting element which is separate from the central elongate shaft and is disposed lengthwise within said filler material.

30. An embossing bowl comprising:

a central elongate shaft having two ends, each end of the shaft having a flange thereon;

said embossing bowl defining between the flanges and about but not within the central elongate shaft, a region which is filled with a filler material; and at least one first elongate conducting element which is separate from the central elongate shaft and is disposed lengthwise within said filler material.

* * * * *